US008210581B2

(12) United States Patent
Cramer

(10) Patent No.: US 8,210,581 B2
(45) Date of Patent: Jul. 3, 2012

(54) DOOR HANDLE ATTACHMENT FIXTURE

(75) Inventor: Randy S. Cramer, Lebanon, PA (US)

(73) Assignee: Newfrey, LLC, Newark, DE (US)

( * ) Notice: Subject to any disclaimer, the term of this patent is extended or adjusted under 35 U.S.C. 154(b) by 544 days.

(21) Appl. No.: 12/384,774

(22) Filed: Apr. 8, 2009

(65) Prior Publication Data

US 2010/0259053 A1 Oct. 14, 2010

(51) Int. Cl.
*E05B 3/00* (2006.01)
*E05B 1/00* (2006.01)

(52) U.S. Cl. . 292/354; 292/348; 292/350; 292/DIG. 53; 292/DIG. 54; 292/DIG. 64

(58) Field of Classification Search ..... 292/347–355, 292/DIG. 53, DIG. 54, DIG. 64
See application file for complete search history.

(56) References Cited

U.S. PATENT DOCUMENTS

| | | | | | |
|---|---|---|---|---|---|
| 610,879 | A | * | 9/1898 | Nesbitt | 411/210 |
| 776,276 | A | * | 11/1904 | Voight | 292/348 |
| 1,139,496 | A | * | 5/1915 | Crouch | 292/348 |
| 1,611,999 | A | * | 12/1926 | Cummins | 292/356 |
| 1,706,598 | A | * | 3/1929 | Archer et al. | 292/348 |
| 2,947,561 | A | | 8/1960 | Holden | |
| 3,471,190 | A | * | 10/1969 | Turnbull et al. | 292/356 |
| 4,042,268 | A | | 8/1977 | Coglan | |
| 4,067,599 | A | * | 1/1978 | Ohno | 292/356 |
| 4,343,502 | A | | 8/1982 | Nelson | |
| 4,460,204 | A | * | 7/1984 | Olsen | 292/356 |
| 4,784,418 | A | | 11/1988 | Pearson et al. | |
| 5,067,758 | A | * | 11/1991 | Fann et al. | 292/347 |
| 5,787,744 | A | * | 8/1998 | Berger et al. | 70/422 |
| 6,997,024 | B2 | | 2/2006 | Etlicher | |
| 7,188,873 | B2 | | 3/2007 | Brown et al. | |
| 7,347,462 | B2 | | 3/2008 | Ellis et al. | |
| 2008/0111384 | A1 | | 5/2008 | Ellis | |

* cited by examiner

*Primary Examiner* — Carlos Lugo
(74) *Attorney, Agent, or Firm* — Ober, Kaler, Grimes & Shriver; Royal W. Craig

(57) ABSTRACT

A door handle assembly for attachment to an escutcheon, the assembly comprising a door handle, wear washer, spindle nut, spindle nut retainer, and shaft retainer. The door handle has a hub, externally threaded for engagement with the internal threads of the spindle nut, with a central hole and axial slots engaging locking tabs of the spindle nut retainer. The wear washer is inserted over the hub between the inside surface of the escutcheon and the spindle nut. The spindle nut is adjusted on the hub until the proper fit and feel is achieved. The spindle nut retainer is placed over the spindle nut to lock it in position, and a shaft retainer is placed over the spindle nut retainer to secure it. The spindle nut provides more contact surface area with the underlying wear washer, reducing cyclic wear, increasing product life, reliability and security.

20 Claims, 3 Drawing Sheets

DOOR HANDLE ATTACHMENT FIXTURE

BACKGROUND OF THE INVENTION

1. Field of the Invention

The present invention relates to door hardware and, more particularly, a door handle attachment fixture that attaches a door handle to an escutcheon.

2. Description of the Background

In the door hardware industry, a common method of attaching a door handle to a mounting plate (or escutcheon) is to extend the hub of a door handle through an aperture in an escutcheon and then attach a C-clip or a retainer clip around the shank, securing the handle to the escutcheon. For example, FIG. 1 is a perspective view of the prior art showing the hub 14 of the door handle inserted through an aperture in an escutcheon 11, and a shank 10 inserted into the hub 14. The hub 14 protrudes up through a washer 13, and a C-clip 12 is affixed about the hub 14 to retain the door handle, effectively securing the handle to the escutcheon 11. Using a C-clip or other form of retainer clip has two major disadvantages. First, to achieve the desired fit and feel of the door handle, all components must have tight tolerances, and this increases the cost of manufacturing. Wide tolerances can cause overly loose or tight door handle function. Second, C-clips or like retainers afford only marginal structural strength, and can result in excessive cyclic wear.

Other attachment fixtures have been attempted.

For example, United States Patent Application No. 2008/0111384 by Ellis published May 15, 2008, discloses an apparatus for retaining a spring and spindle in the shank of a door handle using a torsion spring and retainer ring.

U.S. Pat. No. 7,347,462 to Ellis et al. issued Mar. 25, 2008, discloses a door handle assembly in which the shank of the door handle extends through the aperture of the mounting plate and through two attached bearings. A retainer device, such as a push retainer, a snap ring, or a nut, secures the door handle to the mounting plate.

U.S. Pat. No. 7,188,873 to Brown et al. issued Mar. 23, 2007, discloses a door handle system with a removable locking fastener comprising a nut and a star washer having nubs that engage a groove in the handle. This door handle system, however, does not allow for precise adjustment, and the ears on the fastener must be bent to secure the nut.

U.S. Pat. No. 6,997,024 to Etlicher issued Feb. 14, 2006, discloses a pull door lock in which the shank is retained in the escutcheon plate by engaging a C-clip with a groove at the end of the shank.

U.S. Pat. No. 4,784,418 to Pearson et al. issued Nov. 15, 1988, discloses a door latch handle fitting. To secure the lever handle to the mounting plate, the shank of the lever handle is positioned through the aperture of the mounting plate, and the retainer is pressed onto the shank portion, engaging the gripping tongues with the shank.

U.S. Pat. No. 4,343,502 to Nelson issued Aug. 10, 1982, discloses a doorknob construction in which an externally threaded end of the door handle is inserted through an aperture in the mounting rose, and the door handle is secured by an adjustment bushing nut.

U.S. Pat. No. 4,042,268 to Coglan issued Aug. 16, 1977, discloses a latch or lock set in which the lever is retained to the back plate by slipping a retaining spring over the barrel into two groves on the barrel.

None of the foregoing references fully address the current problem, and instead of affixing a C-clip at a fixed position along the door lever hub, it would be greatly advantageous to provide an adjustable fixture with improved wear resistance and compact size, that can be adjusted and semi-permanently installed in the field.

SUMMARY OF THE INVENTION

The present invention is a door handle attachment fixture that pivotally attaches a door handle to an existing escutcheon. The door handle attachment fixture generally comprises a door handle with protruding hub for insertion through the escutcheon, a wear washer, a spindle nut, a spindle nut retainer, and a shaft retainer. The hub is externally threaded for engagement with the internal threads of the spindle nut, and has a central, longitudinal hole and axial slots. The axial slots engage with locking tabs of the spindle nut retainer. The wear washer is inserted over the hub between the inside surface of the escutcheon and the spindle nut. The spindle nut's internal threads are engaged with the threads on the hub, and the spindle nut is adjusted until the proper fit and feel is achieved. Because the spindle nut can be adjusted along the hub in minute fractions, it eliminates the need for tight tolerance components associated with C-clips or other retainer clips, and can be adjusted in the field. Once adjusted, the spindle nut retainer that conforms to the spindle nut's periphery is placed over the spindle nut, and locking tabs on the spindle nut retainer are engaged with the slots in the hub. This engagement prevents the spindle nut from rotating and backing off the hub. Finally, the shaft retainer is placed onto the hub over the spindle nut retainer to complete the fixture and create a semi-permanent installation. A keyed shank may be inserted into the longitudinal hole in the hub for operation of a locking or latching mechanism.

The spindle nut provides more contact surface area with the underlying wear washer, and this reduces cyclic wear and increases product life and reliability. Further, the door handle attachment fixture provides a lower profile plus a much stronger attachment, which increases product security.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a door handle attachment fixture that pivotally attaches a door handle to an existing escutcheon.

Figure 2:
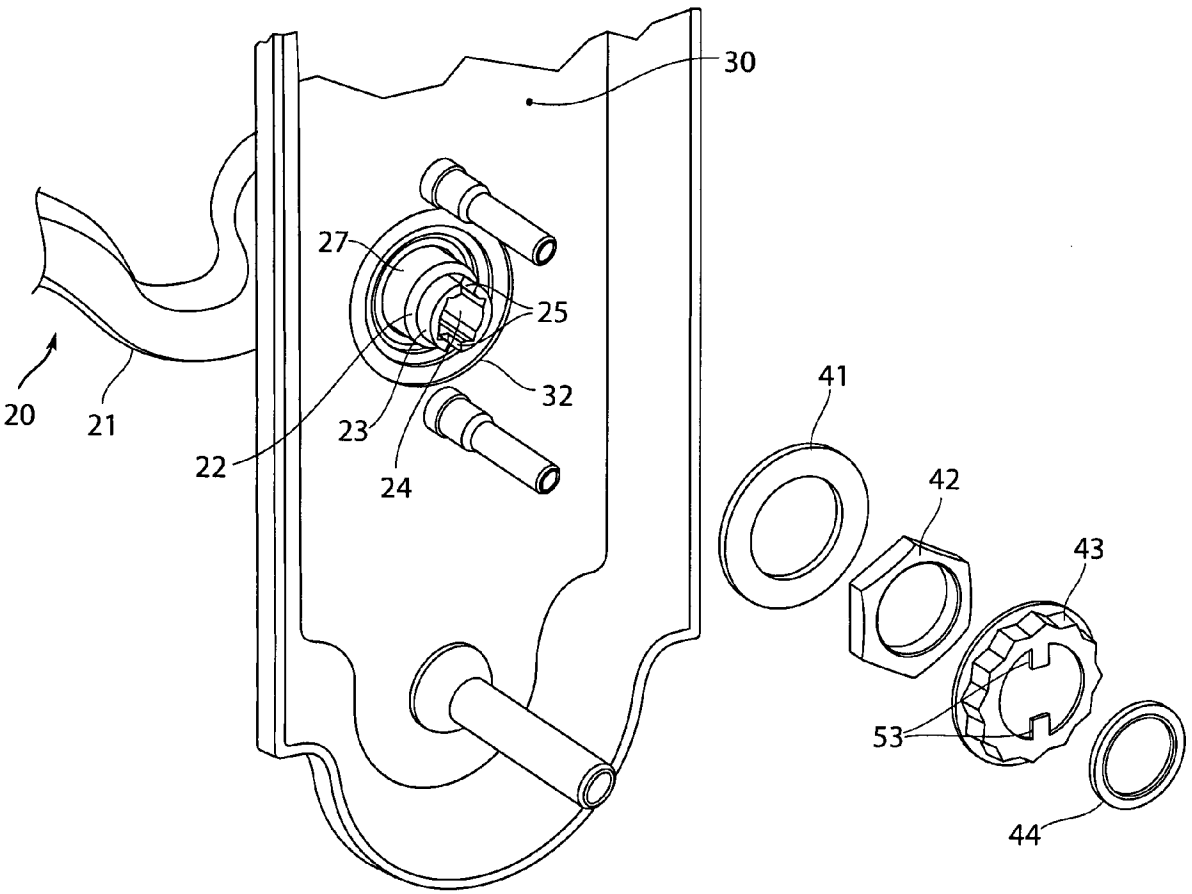
FIG. 2 is a composite exploded view of the door handle attachment fixture according to the present invention.
Figure 3:
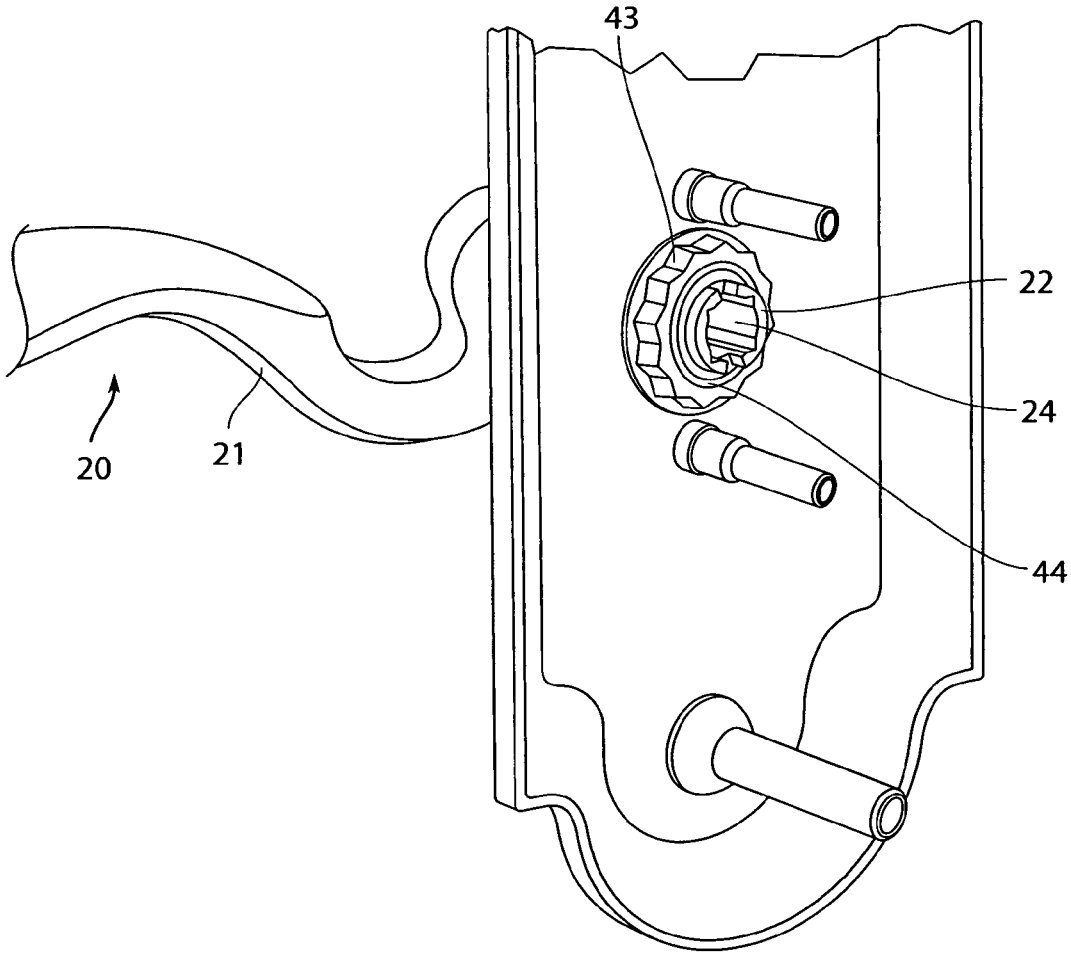
FIG. 3 is an assembled view of the door handle attachment fixture as in FIG. 2.

Referring collectively to FIGS. 2 and 3, the door handle attachment fixture generally comprises a door handle 20 having a protruding hub 22 for insertion through the aperture of a conventional escutcheon 30, a wear washer 41, spindle nut 42, spindle nut retainer 43, and a shaft retainer 44.

The door handle 20 comprises an exterior operator portion 21 which may take any conventional form including a lever (as shown), knob, or otherwise. The operator portion 21 is fixedly attached to the hub 22, so when a user grabs the operator portion 21 and applies rotational force, the hub 22 likewise rotates about its axis. The hub 22 further comprises an annular member terminating at a rim surrounding a longitudinal hole 24 aligned along the rotational axis of the hub 22. The hole 24 of the hub 22 accepts a shank (not shown) that transfers the rotational force to a locking or latching mechanism (not shown) installed in the door. The hole 24 is shown with a square periphery but may be otherwise keyed to the shank to ensure that the shank does not slip within the hole 24 while rotating.

Figure 1:
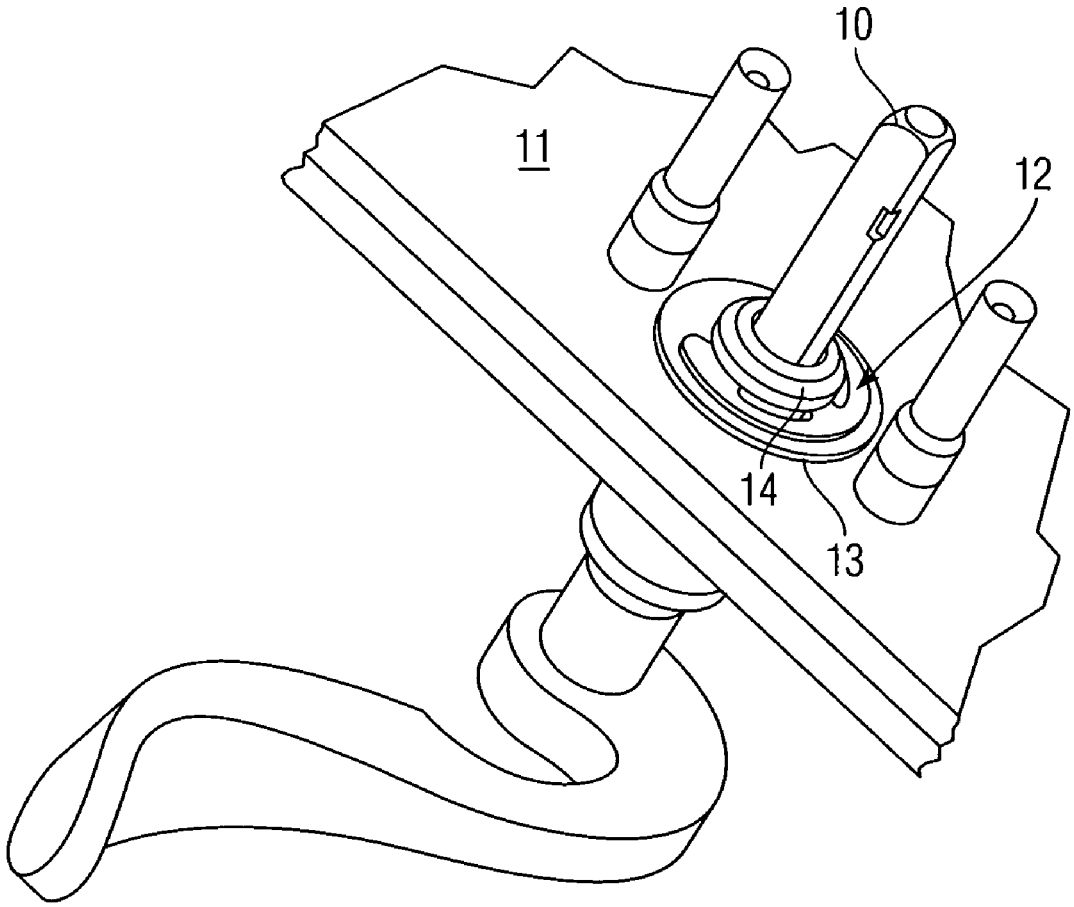
(Prior Art) Fig. 1
FIG. 1 is a perspective view of a prior art door handle.

The distal rim of the hub 22 is circumscribed by a tiered shelf 23 that protrudes outward from a larger diameter base 27 of the hub 22. The rim of hub 22 is further defined by opposing axial slots 25 that interrupt the rim at the distal end of the hub 22. While FIGS. 1 and 2 illustrate an exemplary embodiment including two opposed axial slots 25, the number and location of slots 25 is a matter of design choice.

The base 27 of the hub 22 is threaded with external threads. The threads may have an exemplary thread count of about 32 threads per inch. The hub 22 is positioned through the aperture of the escutcheon 30 and fitted with a wear washer 41 that fits over the base 27 of the hub 22. The wear washer 41 may be a flat polyethylene washer or other suitable plastic material. A spindle nut 42 is inserted onto the hub 22 over the wear washer 41. The spindle nut 42 may be a conventional hexagonal (or other polygonal shape) retaining nut as shown, and is internally threaded to conform to the threaded base 27 of the hub 22. To fasten the door handle 20 to the escutcheon 30, the spindle nut 42 is screwed onto the base 27 of the hub 22.

If desired, the escutcheon 30 may be formed with a concentric recess 32 surrounding the aperture to seat the wear washer 41. In this case, the diameter of the concentric recess 32 should be slightly larger than the diameter of the wear washer 41 to fully seat the wear washer 41. The depth of the recess 32 varies depending on the thickness of the front escutcheon surface. In addition, the wear washer 41 should be thicker than the depth of the recess 32 on the escutcheon 30 to ensure that the wear washer 41 and the spindle nut 42 maintain contact when the door handle 20 is rotated. Thus, the spindle nut 42 is isolated from the escutcheon 30, providing necessary wear resistance.

A spindle nut retainer 43 is then inserted over the spindle nut 42. The spindle nut retainer 43 comprises a concave hood that fits over the spindle nut 42, the concave recess being keyed to the periphery of the spindle nut 42 to prevent rotation. The illustrated embodiment of the spindle nut retainer 43 is a twelve-point retainer as best seen in FIG. 2, such that at any of twelve different rotational positions, the spindle nut retainer 43 will fit the spindle nut 42. The spindle nut retainer 43 is further defined by a central aperture with opposing locking tabs 53 protruding radially into the aperture. The locking tabs 53 extend from the outer periphery of the aperture a short distance towards the center. The locking tabs 53 conform in size and position to the axial slots 25 in the hub 22 (here a pair of opposing tabs) and are designed to seat therein. When placing the spindle nut retainer 43 over the spindle nut 42, the locking tabs 53 engage in the axial slots 25, thus preventing relative rotation of the spindle nut retainer 43 about the hub 22 and hence preventing rotation of the spindle nut 42. Preventing this rotation keeps the spindle nut 42 from backing off the hub 22.

At installation, the spindle nut 42 is tightened onto hub 22 until the desired feel and fit of the door handle 20 is achieved. With the exemplary thread count, spindle nut 42 may be adjusted in about 0.0027" increments. If the door handle 20 is loosely attached to the escutcheon 30, the spindle nut 42 should be tightened more. If the door handle 20 is too tight, the spindle nut 42 should be loosened in the opposite direction. Once the desired fit and feel is achieved, the spindle nut retainer 43 is placed over the spindle nut 42.

Finally, the shaft retainer 44 is pressed onto the rim of the hub 22 atop the spindle nut retainer 43 to secure the nut retainer 43, yielding the completed configuration as shown in FIG. 3. The shaft retainer 44 may be any suitable compression ring sized for a friction fit onto the rim of the hub 22, and a rubber grommet conforming to the hub 22 will suffice. In an alternative embodiment, the shaft retainer 44 may be a snap ring.

The hole 24 in the hub 22 remains open for insertion of a shank.

One skilled in the art will now see that the foregoing assembly pivotally attaches the door handle 20 to the escutcheon 30 without the need for tight-tolerance parts, because the spindle nut 42 can be adjusted in thousandths of an inch. This improves product security by providing a stronger attachment method, and the increased contact surface area of the spindle nut 42 with the wear washer 41 reduces cyclic wear and increases product life and reliability. When fully assembled as shown in FIG. 3, the door handle attachment fixture is compact and low profile (minimal height), but maximum security. It provides the proper fit and feel, avoids the need for tight-tolerance components, reduces cyclic wear and increases door handle operational life and reliability.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A door handle assembly for attachment to an escutcheon, comprising:

a door handle having an operator portion and a hub for insertion through an aperture in said escutcheon, said hub being further defined by a threaded base and a rim protruding from said base, said rim being interrupted by a plurality of axial slots;

a wear washer sized for insertion over said hub;

a polygonal spindle nut internally threaded for screw-insertion onto the threaded base of said hub over said wear washer;

a spindle nut retainer defined by a recess keyed to said spindle nut to encase said spindle nut and prevent rotation, said spindle nut retainer having an aperture with a plurality of protruding locking tabs for seating within the axial slots in said hub;

a shaft retainer for securing the spindle nut retainer on the hub of said door handle.

2. The door handle assembly according to claim 1, wherein the shaft retainer is inserted on the rim of said hub for retaining said spindle nut retainer thereon.

3. The door handle assembly according to claim 1 wherein said operator portion comprises either a knob or lever.

4. The door handle assembly of claim 1 wherein said hub further comprises a central, longitudinal hole having a non-circular periphery.

5. The door handle assembly of claim 1 wherein said threaded base and said polygonal spindle nut have a thread count of about 32 threads per inch.

6. The door handle assembly of claim 1 wherein said spindle nut has a hexagonal shape.

7. The door handle assembly of claim 1 wherein said spindle nut retainer is a twelve-point retainer.

8. The door handle assembly of claim 1 wherein said plurality of axial slots are a pair of opposing slots and wherein said plurality of locking tabs are a pair of opposing tabs.

9. The door handle assembly of claim 1 wherein said escutcheon further comprises a concentric recess around the aperture.

10. The door handle attachment fixture of claim 1 wherein said wear washer comprises plastic.

11. A method of attaching a door handle to an escutcheon to obtain the correct fit and feel, comprising the steps of:

providing a door handle having an operator portion and a hub for insertion through an aperture in said escutcheon, said hub being further defined by a threaded base and a rim protruding from said base, said rim being interrupted by a plurality of axial slots;

positioning the hub through an aperture in said escutcheon;

placing a wear washer sized for insertion over said hub onto said hub and adjacent to said escutcheon;

engaging a polygonal spindle nut internally threaded for screw-insertion onto the threaded base of said hub over said wear washer until the desired fit and feel is achieved; and placing a spindle nut retainer defined by a recess keyed to said spindle nut and by an aperture with a plurality of protruding locking tabs for seating within the axial slots in said hub over said spindle nut and engaging said locking tabs with the axial slots in said hub;

attaching a shaft retainer to said hub to secure the spindle nut retainer thereon.

12. The method of attaching a door handle to an escutcheon according to claim 11, wherein said step of attaching the shaft retainer to said hub further comprises pressing said shaft retainer on the rim of said hub for retaining said spindle nut retainer thereon.

13. The method of attaching a door handle to an escutcheon according to claim 11 wherein said operator portion comprises either a knob or lever.

14. The method of attaching a door handle to an escutcheon according to claim 11 wherein said hub further comprises a central, longitudinal hole having a non-circular periphery.

15. The method of attaching a door handle to an escutcheon according to claim 11 wherein said threaded base and said polygonal spindle nut have a thread count of about 32 threads per inch.

16. The method of attaching a door handle to an escutcheon according to claim 11 wherein said spindle nut has a hexagonal shape.

17. The method of attaching a door handle to an escutcheon according to claim 11 wherein said spindle nut retainer is a twelve-point retainer.

18. The method of attaching a door handle to an escutcheon according to claim 11 wherein said plurality of axial slots are a pair of opposing slots and wherein said plurality of locking tabs are a pair of opposing tabs.

19. The method of attaching a door handle to an escutcheon according to claim 11 wherein said escutcheon further comprises a concentric recess around the aperture.

20. The method of attaching a door handle to an escutcheon according to claim 11 wherein said wear washer comprises plastic.

* * * * *